US010991359B2

(12) United States Patent
Pompei

(10) Patent No.: US 10,991,359 B2
(45) Date of Patent: Apr. 27, 2021

(54) ULTRASONIC TRANSDUCERS

(71) Applicant: Frank Joseph Pompei, Wayland, MA (US)

(72) Inventor: Frank Joseph Pompei, Wayland, MA (US)

( * ) Notice: Subject to any disclaimer, the term of this patent is extended or adjusted under 35 U.S.C. 154(b) by 488 days.

(21) Appl. No.: 15/762,289

(22) PCT Filed: Sep. 23, 2016

(86) PCT No.: PCT/US2016/053328
§ 371 (c)(1),
(2) Date: Mar. 22, 2018

(87) PCT Pub. No.: WO2017/053716
PCT Pub. Date: Mar. 30, 2017

(65) Prior Publication Data

US 2018/0301138 A1 Oct. 18, 2018

Related U.S. Application Data

(60) Provisional application No. 62/222,916, filed on Sep. 24, 2015.

(51) Int. Cl.
*G10K 13/00* (2006.01)
*H04R 19/01* (2006.01)
(Continued)

(52) U.S. Cl.
CPC ..... *G10K 13/00* (2013.01); *B06B 1/0292* (2013.01); *H04R 19/013* (2013.01); *H04R 7/24* (2013.01); *H04R 2217/03* (2013.01)

(58) Field of Classification Search
CPC .. G10K 13/00; H04R 19/013; H04R 2217/03; H04R 7/24; B06B 1/0292
See application file for complete search history.

(56) References Cited

U.S. PATENT DOCUMENTS 3,908,098 A * 9/1975 Kawakami ..... H04R 19/00 367/189
6,044,160 A * 3/2000 Norris ..... B06B 1/0292 381/116
(Continued)

FOREIGN PATENT DOCUMENTS

EP 1677575 A2 * 7/2006 ..... H04R 7/06

*Primary Examiner* — Jeremy A Luks
(74) *Attorney, Agent, or Firm* — BainwoodHuang

(57) ABSTRACT

Ultrasonic transducers that include membrane films and perforated baseplates. An ultrasonic transducer includes a baseplate having a conductive surface with a plurality of apertures, openings, or perforations formed thereon or therethrough, and a membrane film having a conductive surface. The membrane film is positioned adjacent to the apertures, openings, or perforations formed on or through the baseplate. By applying a voltage between the conductive surface of the membrane film and the conductive surface of the baseplate, an electrical force of attraction can be created between the membrane film and the baseplate. Varying this applied voltage can cause the membrane film to undergo vibrational motion. The dimensions corresponding to the size and/or shape of the apertures, openings, or perforations formed on or through the baseplate can be varied so that different regions of the baseplate produce different frequency responses, allowing the net bandwidth of the ultrasonic transducer to be increased.

15 Claims, 6 Drawing Sheets

(51) Int. Cl.
*B06B 1/02* (2006.01)
*H04R 7/24* (2006.01)

(56) References Cited

U.S. PATENT DOCUMENTS

| | | | | |
|---|---|---|---|---|
| 6,201,874 | B1 | 3/2001 | Croft, III et al. | |
| 8,009,838 | B2 * | 8/2011 | Lee | H04R 1/40 381/77 |
| 8,138,034 | B2 * | 3/2012 | Han | H04R 31/00 438/191 |
| 2002/0135272 | A1 | 9/2002 | Toda | |
| 2005/0002536 | A1 * | 1/2005 | Gorelik | B06B 1/0292 381/150 |
| 2005/0244016 | A1 * | 11/2005 | Norris | H04B 5/0006 381/77 |
| 2007/0164632 | A1 * | 7/2007 | Adachi | B06B 1/0292 310/311 |
| 2008/0285777 | A1 * | 11/2008 | Pompei | B06B 1/0622 381/116 |
| 2014/0232236 | A1 * | 8/2014 | Atkins | H04R 19/02 310/300 |

* cited by examiner

ULTRASONIC TRANSDUCERS

CROSS-REFERENCE TO RELATED APPLICATIONS

This application claims benefit of the priority of U.S. Provisional Patent Application No. 62/222,916 filed Sep. 24, 2015 entitled ULTRASONIC TRANSDUCERS.

TECHNICAL FIELD

The present application relates generally to ultrasonic transducers, and more specifically to ultrasonic transducers that include perforated baseplates.

BACKGROUND

The physics of ultrasonic transducers generally involves a membrane film that is attracted to a surface, such as a surface of a baseplate, through the action of a variable electric field. The variable electric field can be produced by applying a voltage difference (e.g., an AC voltage) between a conductive surface of the membrane film and a conductive surface of the baseplate. For example, the baseplate may be made of a conductive material such as aluminum. The variable electric field produced between the conductive surfaces of the membrane film and the baseplate can create an electrical force of attraction that is approximately proportional to the square of the voltage between the conductive surfaces. Generally, a DC bias voltage (e.g., a few hundred volts) is applied between the conductive surfaces of the membrane film and the baseplate, onto which an AC voltage or drive signal can be added.

Prior ultrasonic transducer designs have typically employed a conductive aluminum baseplate and a metalized polymer membrane film. Such a baseplate can include a plurality of depressions (e.g., a series of grooves) in its surface that partially penetrate the baseplate. The depressions are configured to facilitate vibrational motion of the membrane film. Trapped or restricted air within these depressions can compress and expand as the membrane film moves, and act as an acoustic "spring" or compliance, which provides a restoring force against the membrane film, facilitating vibration. The configuration of the depressions, including their depth, spacing, shape, etc., combined with the material properties of the membrane film can determine the dynamics of the membrane film's vibrational motion. This design concept is employed in what are commonly known as Sell-type ultrasonic transducers, which have long been used in industry.

SUMMARY

In accordance with the present application, ultrasonic transducers are disclosed that include membrane films and perforated baseplates. In one aspect, an exemplary ultrasonic transducer includes at least one baseplate having a conductive surface with a plurality of apertures, openings, or perforations formed on or through the baseplate. The ultrasonic transducer further includes a membrane film having at least one conductive surface. The membrane film can be positioned adjacent or proximate to the apertures, openings, or perforations formed on or through the baseplate. By applying a voltage between the conductive surface of the membrane film and the conductive surface of the baseplate, an electrical force of attraction can be created between the membrane film and the baseplate. Varying this applied voltage can cause the membrane film to undergo vibrational motion.

In an exemplary aspect, the size and/or shape of the apertures, openings, or perforations formed on or through the baseplate can determine the frequency response of the ultrasonic transducer. The dimensions corresponding to the size and/or shape of the apertures, openings, or perforations can be varied so that different regions of the baseplate produce different frequency responses of the ultrasonic transducer, allowing the net bandwidth of the ultrasonic transducer to be increased, as desired. The dimensions of the size and/or shape of the apertures, openings, or perforations can be substantially the same, or production processes can be relied upon to provide some small variation(s) in the dimensions of the respective apertures, openings, or perforations. In a further exemplary aspect, the baseplate can have circular, elongated, slotted, square, oval, or any other suitable size, shape, and/or dimensions of the respective apertures, openings, or perforations formed on or through the baseplate. Unlike conventional ultrasonic transducer designs, there is no trapped air in a number of the disclosed ultrasonic transducer configurations, and therefore there is negligible acoustic compliance providing a restoring force to the membrane film. Rather, the bending stiffness of the membrane film provides for a substantial restoring force. When the membrane film is placed in contact with the baseplate, this bending stiffness is particularly well suited to provide a restoring force in the frequency range desired by the disclosed ultrasonic transducers.

Other features, functions, and aspects of the invention will be evident from the Detailed Description that follows.

BRIEF DESCRIPTION OF THE DRAWINGS

The accompanying drawings, which are incorporated in and constitute a part of this specification, illustrate one or more embodiments described herein, and, together with the Detailed Description, explain these embodiments. In the drawings.

DETAILED DESCRIPTION

Ultrasonic transducers are disclosed that include membrane films and perforated baseplates. An exemplary ultrasonic transducer includes at least one baseplate having a conductive surface with a plurality of apertures, openings, or perforations formed on or through the baseplate. The ultrasonic transducer further includes a membrane film having at least one conductive surface. The membrane film can be positioned adjacent or proximate to the apertures, openings, or perforations formed on or through the baseplate. By applying a voltage between the conductive surface of the membrane film and the conductive surface of the baseplate, an electrical force of attraction can be created between the membrane film and the baseplate. Varying this applied voltage can cause the membrane film to undergo vibrational motion. The dimensions corresponding to the size and/or shape of the apertures, openings, or perforations formed on or through the baseplate can be varied so that different regions of the baseplate produce different frequency responses of the ultrasonic transducer, allowing the net bandwidth of the ultrasonic transducer to be advantageously increased.

Figure 1A:
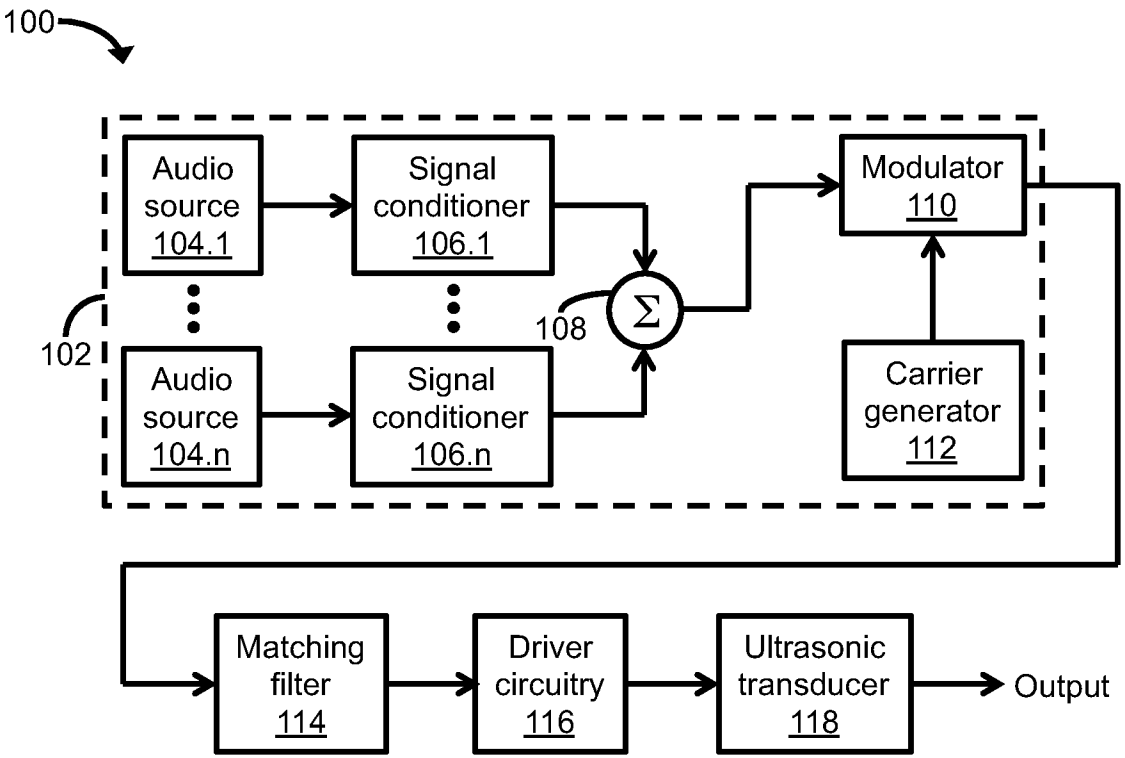
FIG. 1*a* is a block diagram of an exemplary parametric audio system, in which an exemplary ultrasonic transducer may be employed, in accordance with the present application.

FIG. 1*a* depicts an illustrative embodiment of an exemplary parametric audio system 100, which includes an exemplary ultrasonic transducer 118, in accordance with the present application. As shown in FIG. 1*a*, the parametric audio system 100 can include a signal generator 102, a matching filter 114, driver circuitry 116, and the ultrasonic transducer 118. The signal generator 102 can include a plurality of audio sources 104.1-104.*n*, a plurality of signal conditioners 106.1-106.*n*, summing circuitry 108, a modulator 110, and a carrier generator 112. In an exemplary mode of operation, the audio sources 104.1-104.*n* can generate a plurality of audio signals, respectively. The plurality of signal conditioners 106.1-106.*n* can receive the plurality of audio signals, respectively, perform signal conditioning on the respective audio signals, and provide the conditioned audio signals to the summing circuitry 108. For example, the plurality of signal conditioners 106.1-106.*n* may each be configured to include nonlinear inversion circuitry for reducing or substantially eliminating unwanted distortion in any audio that may be reproduced from an output of the parametric audio system 100. The plurality of signal conditioners 106.1-106.*n* may each further include equalization circuitry, compression circuitry, or any other suitable signal conditioning circuitry. It is noted that such signal conditioning of the plurality of audio signals can alternatively be performed after the audio signals are summed by the summing circuitry 108.

The summing circuitry 108 can sum the conditioned audio signals, and provide a composite audio signal to the modulator 110. Further, the carrier generator 112 can generate an ultrasonic carrier signal, and provide the ultrasonic carrier signal to the modulator 110. The modulator 110 can then modulate the ultrasonic carrier signal with the composite audio signal. For example, the modulator 110 may be configured to perform amplitude modulation by multiplying the composite audio signal with the ultrasonic carrier signal, or any other suitable form of modulation for converting audio-band signal(s) to ultrasound. Having modulated the ultrasonic carrier signal with the composite audio signal, the modulator 110 can provide the modulated signal to the matching filter 114. For example, the matching filter 114 may be configured to compensate for unwanted distortion resulting from a non-flat frequency response of the driver circuitry 116 and/or the ultrasonic transducer 118.

The driver circuitry 116 can receive the modulated ultrasonic carrier signal from the matching filter 114, and provide an amplified version of the modulated ultrasonic carrier signal to the ultrasonic transducer 118, which can emit from its output at high intensity the amplified, modulated ultrasonic carrier signal as an ultrasonic beam. For example, the driver circuitry 116 may be configured to include one or more delay circuits (not shown) for applying a relative phase shift across frequencies and multiple output channels of the modulated ultrasonic carrier signal, sent to multiple transducers or transducer elements, in order to steer, focus, and/or shape the ultrasonic beam emitted by the ultrasonic transducer 118. Once emitted from the output of the ultrasonic transducer 118, the ultrasonic beam can be demodulated as it passes through the air or any other suitable propagation medium, due to nonlinear propagation characteristics of the air or other propagation medium. Having demodulated the ultrasonic beam upon its passage through the air or other propagation medium, audible sound can be produced. It is noted that the audible sound produced by way of such a nonlinear parametric process is approximately proportional to the square of the modulation envelope.

Figure 1B:
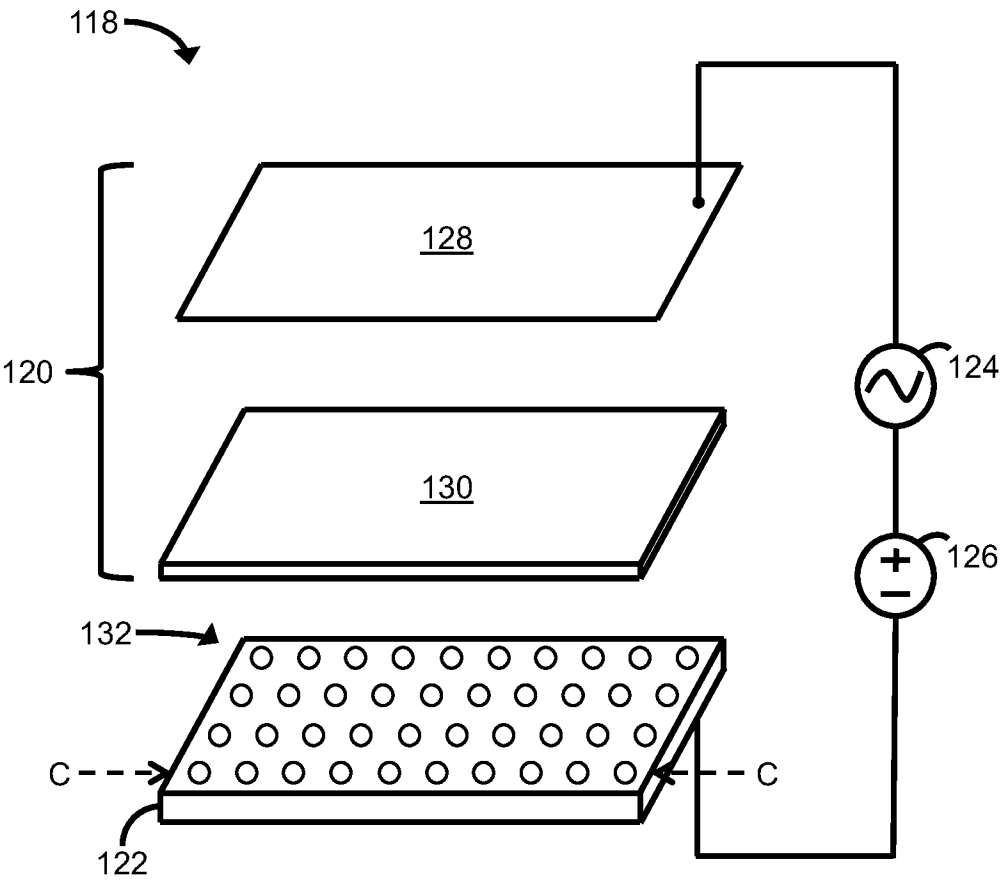
FIG. 1*b* is an exploded perspective view of the ultrasonic transducer of FIG. 1*a;*

FIG. 1*b* depicts an exploded perspective view of the ultrasonic transducer 118 of FIG. 1*a*. As shown in FIG. 1*b*, the ultrasonic transducer 118 can include an exemplary vibrator layer 120 and an exemplary perforated baseplate 122. The vibrator layer 120 can include a membrane film 130 having a conductive surface 128. The perforated baseplate 122 can include a plurality of apertures, openings, or perforations 132 (e.g., circular apertures, openings, or perforations) formed thereon or therethrough. For example, the membrane film 130 may be implemented with a thin (e.g., about 0.2-100.0 μm (about 0.008-3.937 mil), typically about 8 μm (about 0.315 mil), in thickness) polyester, polyimide, polyvinylidene fluoride (PVDF), polyethylene terephthalate (PET), polytetrafluoroethylene (PTFE) film, or any other suitable polymeric or non-polymeric film. Further, the conductive surface 128 of the membrane film 130 may be implemented with a coating of aluminum, gold, nickel, or any other suitable conductive material. In addition, the perforated baseplate 122 may be made of or coated with aluminum or any other suitable conductive material, and the plurality of apertures, openings, or perforations 132 formed on or through the perforated baseplate 122 may be circular, elongated, slotted, square, oval, or any other suitable shape.

As shown in FIG. 1*b*, a DC bias voltage source 126 (e.g., 150 $V_{DC}$) can be connected across the conductive surface 128 of the membrane film 130 and a conductive surface of the baseplate 122. The DC bias voltage source 126 can increase the sensitivity and output capability of the ultrasonic transducer 118, as well as reduce unwanted distortion in the ultrasonic beam emitted by the ultrasonic transducer 118. In one embodiment, the membrane film 130 may have electret properties, allowing the vibrator layer 120 to function as a DC bias source in place of the DC bias voltage source 126. It is noted that, in FIG. 1*b*, the amplified, modulated ultrasonic carrier signal provided to the ultrasonic transducer 118 by the driver circuitry 116 is represented by a time-varying signal generated by an AC signal source 124, which is connected with the DC bias voltage source 126 such that the voltage delivered to the ultrasonic transducer 118 is the sum of DC and AC components.

Figure 2A:
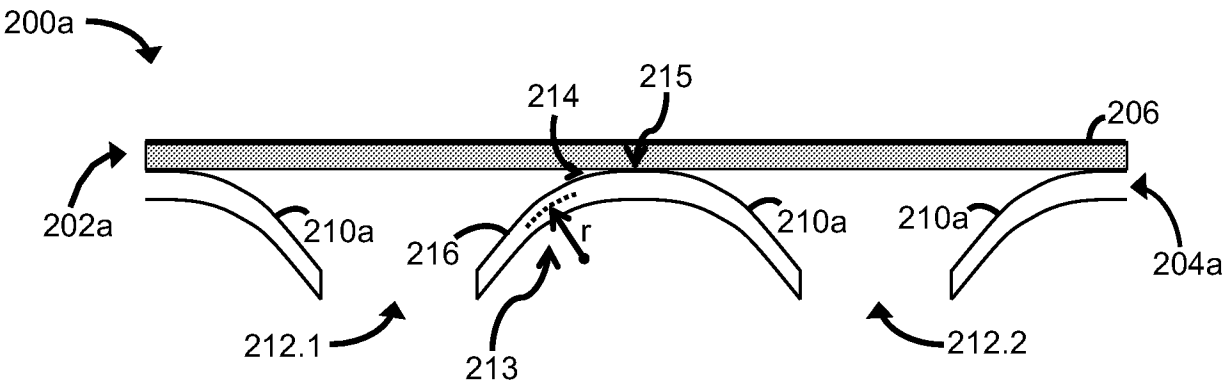
FIG. 2*a* is a cross-sectional view of an exemplary embodiment of the ultrasonic transducer of FIGS. 1*a* and 1*b*, in which the ultrasonic transducer includes a membrane film and a perforated baseplate.

FIG. 2*a* depicts a partial cross-sectional view (e.g., partially across a cross-section C-C; see FIG. 1*b*) of an exemplary embodiment 200*a* (also referred to herein as the ultrasonic transducer 200*a*) of the ultrasonic transducer 118 of FIGS. 1*a* and 1*b*. As shown in FIG. 2*a*, the ultrasonic transducer 200*a* can include a membrane film 202*a* and a perforated baseplate 204*a*. The perforated baseplate 204*a* can include a surface 210*a* with a plurality of apertures, openings, or perforations 212.1-212.2 formed thereon or therethrough. The membrane film 202*a* can have a conductive surface 206. The non-conductive surface of the membrane film 202*a* opposite the conductive surface 206 can be placed adjacent to, proximate to, or directly against the surface 210*a* with the plurality of apertures, openings, or perforations 212.1-212.2 formed in the perforated baseplate 204*a*. In one embodiment, the perforated baseplate 204*a* can be made of aluminum or any other suitable conductive material. In an alternative embodiment, the perforated baseplate 204*a* can be made of an insulating material (e.g., plastic) that has a conductive surface (e.g., a coating of conductive material such as aluminum, gold, or nickel). By applying a voltage between the conductive surface 206 of the membrane film 202*a* and the conductive surface of the perforated baseplate 204*a*, an electrical force of attraction can be created between the membrane film 202*a* and the perforated baseplate 204*a*. Varying this applied voltage can cause the membrane film 202*a* to undergo vibrational motion.

It is noted that the membrane film included in each of the ultrasonic transducers disclosed herein, such as the membrane film 202*a*, can be under tension and have electret properties that provide an effect similar to a level of a DC bias voltage. Such tension on the membrane film 202*a* can be controlled for the purpose of adjusting the bending stiffness of the membrane film 202*a*, as well as the restoring force of the membrane film 202*a* as it undergoes displacement during vibrational motion. Such tension can also be applied to the membrane film 202*a* by an external fixture (not shown) configured to impart a desired tension force to the membrane film 202*a*, or by the application of a suitable force between the membrane film 202*a* and the baseplate 204*a*. Such tension on the membrane film 202*a* can be uniform across the surface of the membrane film 202*a*, or vary according to position on the membrane film surface. Moreover, the direction of the tension force can be directional or omnidirectional.

Unlike prior ultrasonic transducer designs that typically employ trapped or restricted air as the dominant determining factor of the vibration dynamics of an ultrasonic transducer, the vibration dynamics of the ultrasonic transducer 200*a* (see FIG. 2*a*) are chiefly determined by the bending stiffness of the membrane film 202*a*, and/or the impedance of the apertures, openings, or perforations 212.1-212.2 formed on or through the perforated baseplate 204*a*. In the case where the non-conductive surface of the membrane film 202*a* is placed directly against and in contact with the surface 210*a* of the perforated baseplate 204*a* (e.g., directly against and in contact with upper portions of the surface 210*a*, such as an upper portion 215; see FIG. 2*a*), the distance from the center of the thickness of the membrane film 202*a* to the surface of the membrane film 202*a* in contact with the upper portion 215 is small, and the bending stiffness of the membrane film 202*a* at the location of contact with the upper portion 215 is high, resulting in a strong and consistent restoring force as the membrane film 202*a* bends and/or stretches during vibrational motion. In addition, because an electrical force of attraction is known to be inversely proportional to the distance between oppositely-charged electrodes, having the conductive surface 206 of the membrane film 202*a* (e.g., corresponding to a positively-charged electrode) and the conductive surface of the baseplate 204*a* (e.g., corresponding to a negatively-charged electrode) situated as close as possible, such as when the membrane film is in contact with the baseplate, can maximize both the electrical force of attraction and the restoring force, thereby maximizing the output of the ultrasonic transducer 200*a*. Providing a structural curve or radius near the portions 214 and 215 allows for a very close spacing between the electrodes formed by the conductive surfaces of the baseplate 204*a* and the membrane film 202*a*, resulting in a strong driving force while still allowing vibrational motion of the membrane film 202*a*.

Figure 2B:
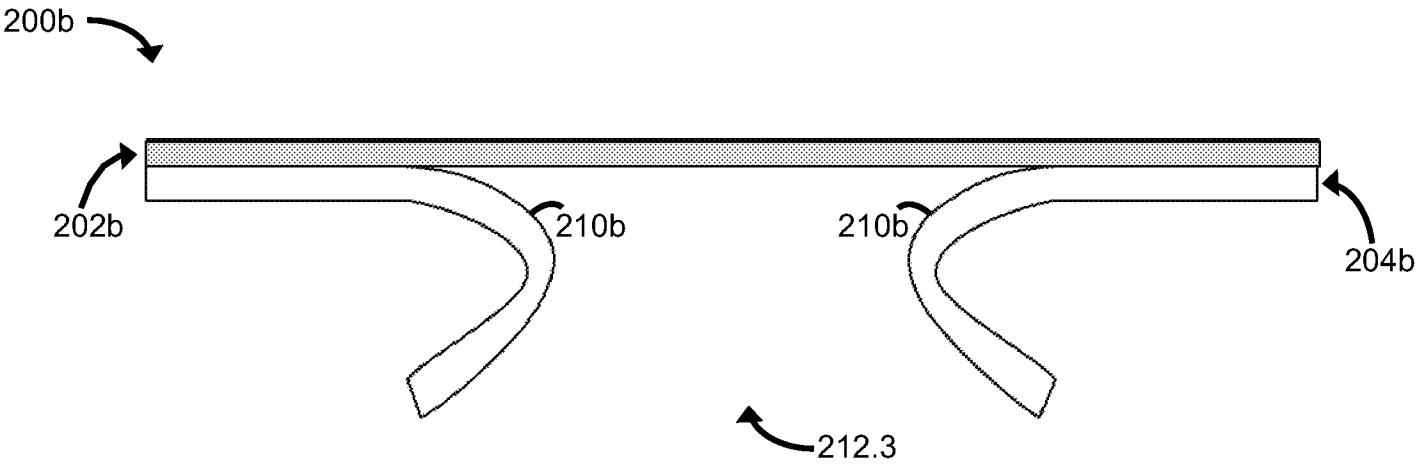
FIG. 2*b* is a cross-sectional view of an alternative embodiment of the ultrasonic transducer of FIG. 2*a*, in which the perforated baseplate has flared apertures, openings, or perforations formed thereon or therethrough.

The size and/or shape of the apertures, openings, or perforations 212.1-212.2 can be specified to determine the frequency response of the ultrasonic transducer 200*a*. The dimensions corresponding to the size and/or shape of the apertures, openings, or perforations 212.1-212.2 can also be varied within one ultrasonic transducer assembly, so that different regions of the perforated baseplate 204*a* can produce different frequency responses of the ultrasonic transducer 200*a*, and the net bandwidth of the ultrasonic transducer 200*a* can be increased, as desired. The dimensions of the size and/or shape of the apertures, openings, or perforations 212.1-212.2 can be substantially the same, or production processes can be relied upon to provide some small variation(s) in the dimensions of the respective apertures, openings, or perforations 212.1-212.2. The apertures, openings, or perforations 212.1-212.2 can be any suitable size, shape, and/or configuration. For example, the apertures, openings, or perforations 212.1-212.2 may be circular, elongated, slotted, square, oval, or any other suitable shape. Such apertures, openings, or perforations formed on or through the perforated baseplate 204*a* may also be flared like acoustic horns in order to provide increased output levels. FIG. 2*b* depicts an ultrasonic transducer 200*b* that includes at least one such flared aperture, opening, or perforation 112.3, which is formed in a surface 210*b* of a perforated baseplate 204*b*. The ultrasonic transducer 200*b* can further include a membrane film 202*b*, which can be placed adjacent or proximate to the flared apertures, openings, or perforations (e.g., the flared aperture, opening, or perforation 112.3) formed in the perforated baseplate 204*b*.

The apertures, openings, or perforations 212.1-212.2 of the perforated baseplate 204*a* can be formed using any suitable molding, forming, or punching process, resulting in the formation of a plurality of dimples (e.g., a dimple 213; see FIG. 2*a*) in the surface 210*a* of the perforated baseplate 204*a*. As shown in FIG. 2*a*, the dimple 213 can have a shallow sloping portion 214 that is essentially tangent to the upper portion 215 (see FIG. 2*a*) of the surface 210*a* near the membrane film 202*a*. For example, each upper portion 215 may correspond to a portion of the surface 210*a* of the perforated baseplate 204*a* that was not deformed by the punching process, and may therefore be at least partially flat. The dimple 213 can also have a wall portion 216 with an increased slope. The shallow sloping portion 214 of the dimple 213 can smoothly transition to the wall portion 216 with the increased slope, which terminates at the aperture, opening, or perforation 212.1. The radius of curvature, r (see FIG. 2*a*), of the dimple 213 can be relatively large, for example, about 203.2 μm (8 mil), 1270 μm (50 mil), 2540 μm (100 mil), 5080 μm (200 mil), or any other suitable radius of curvature. The punching process used to form the apertures, openings, or perforations 212.1-212.2 can employ standard punches and/or perforating machines, creating the plurality of dimples (e.g., the dimple 213) on one side of the baseplate 204*a* as the punches move through the baseplate material. Once the baseplate 204*a* is cut by the punches, a plurality of metal-edged holes (apertures, openings, perforations) may remain on the opposite side of the perforated baseplate 204*a*. In one embodiment, the membrane film 202*a* can be placed directly against the upper portions of the surface 210*a* (e.g., the upper portion 215) on the smoother side of the perforated baseplate 204*a* in order to provide an increased force on the membrane film 202*a*, as well as provide for an increased ruggedness of the overall ultrasonic transducer design.

It is noted that the electrical force of attraction created between the membrane film 202*a* and the perforated baseplate 204*a* is inversely proportional to the distance between the membrane film 202*a* and the shallow sloping portion 214 of the dimple 213. Because the distance between the membrane film 202*a* and the shallow sloping portion 214 is kept small at a location near the upper portion 215, the electrical force of attraction between the membrane film 202*a* and the perforated baseplate 204*a* is increased at such locations, and is the source of essentially all of the vibrational motion of the membrane film 202*a*.

It is further noted that the ultrasonic transducer 200*a* (see FIG. 2*a*) can direct and radiate its output energy from either side (or both sides) of the perforated baseplate 204*a*, i.e., from the smoother side of the perforated baseplate 204*a* with the upper portions of the surface 210*a* (e.g., the upper portion 215), or from the opposite side of the perforated baseplate 204*a* with the plurality of metal-edged holes (e.g., forming the plurality of apertures, openings, or perforations 212.1, 212.2). The non-radiating side of the perforated baseplate 204*a* can be left open, or can be made to terminate at one or more chambers (e.g., one or more chambers 320.1-320.2; see FIG. 3), which can be either empty or filled with any suitable acoustic absorbing material. Further, one or more acoustic elements can be implemented on the non-radiating side of the perforated baseplate 204*a* in order to reinforce the output of the ultrasonic transducer 200*a*. Such chambers (e.g., the chambers 320.1-320.2; see FIG. 3) can be implemented as trapped air chambers, such as resonant cavities having dimensions that optimally redirect and/or reflect output energy from the non-radiating side of the perforated baseplate 204*a* back to the radiating side of the perforated baseplate 204*a* opposite the respective chambers. If the ultrasonic transducer 200*a* is configured to direct and radiate its output energy from the side of the perforated baseplate 204*a* with the plurality of metal (or other suitable strong material)-edged holes, then the use of an additional layer (e.g., a screen) for protecting the relatively fragile membrane film 202*a* can be avoided, so long as the plurality of apertures, openings, or perforations 212.1, 212.2 are kept small. In such a configuration, the perforated backplate 204*a* not only imparts force to the membrane film 202*a*, but also serves to protect the membrane film 202*a* from damage. Such a configuration can also simplify the assembly of the ultrasonic transducer 200*a*, as well as reduce its cost.

Figure 3:
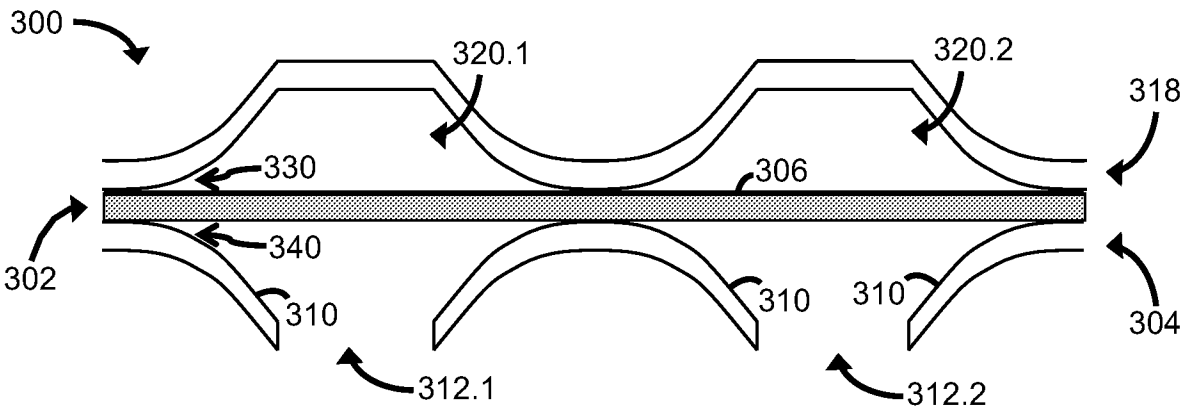
FIG. 3 is a cross-sectional view of a further exemplary embodiment of the ultrasonic transducer of FIGS. 1*a* and 1*b*, in which the ultrasonic transducer includes a membrane film, a perforated baseplate, and a structure forming a plurality of chambers on a non-radiating side of the perforated baseplate.

FIG. 3 depicts a partial cross-sectional view of a further exemplary embodiment 300 (also referred to herein as the ultrasonic transducer 300) of the ultrasonic transducer 118 of FIGS. 1*a* and 1*b*. As shown in FIG. 3, the ultrasonic transducer 300 includes a membrane film 302 and a perforated baseplate 304. The perforated baseplate 304 includes a surface 310 with a plurality of apertures, openings, or perforations 312.1-312.2 formed thereon or therethrough. The membrane film 302 can have a conductive surface 306, and can be placed adjacent or proximate to the apertures, openings, or perforations 312.1-312.2 formed on or through the perforated baseplate 304. By applying a voltage between the conductive surface 306 of the membrane film 302 and a conductive surface of the perforated baseplate 304, an electrical force of attraction can be created between the membrane film 302 and the perforated baseplate 304. Varying this applied voltage can cause the membrane film 302 to undergo vibrational motion.

The ultrasonic transducer 300 of FIG. 3 can further include a structure 318 that forms the plurality of closed chambers 320.1-320.2 for absorbing, redirecting, and/or reflecting output energy from the non-radiating side of the perforated baseplate 304 back to the radiating side of the perforated baseplate 304 opposite the respective chambers 320.1-320.2. The plurality of chambers 320.1-320.2 can also provide an acoustic compliance to enhance vibration dynamics of the membrane film 302. For example, the structure 318 forming the plurality of chambers 320.1-320.2 may be made from any suitable conductive material, or any suitable non-conductive material, which, for example, may be molded from plastic or any other suitable material. Further, the plurality of chambers 320.1-320.2 may be configured to be in registration or aligned with the plurality of apertures, openings, or perforations 312.1-312.2, respectively, or a single chamber may be configured to align with several such apertures, openings, or perforations.

Figure 4:
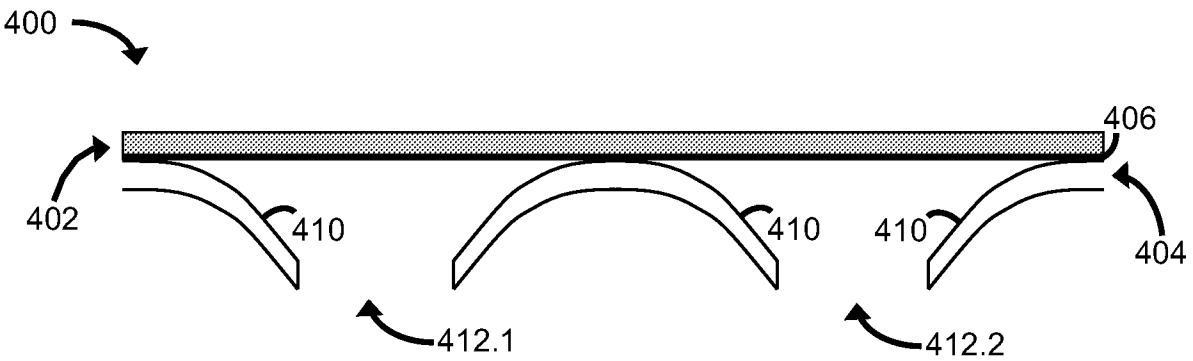
FIG. 4 is a cross-sectional view of another exemplary embodiment of the ultrasonic transducer of FIGS. 1*a* and 1*b*, in which the ultrasonic transducer includes a membrane film having a conductive surface, and a perforated baseplate, and the conductive surface of the membrane film is positioned adjacent or proximate to the perforated baseplate.

It is noted that the curved structure of the respective chambers 320.1-320.2 (see, e.g., a curved structural portion 330), as well as the curved structure of the surface 310 of the perforated baseplate 304 (see, e.g., a curved structural portion 340) can be configured to allow for substantially free movement of the membrane film 302 between the structure 318 and the perforated baseplate 304 while it undergoes vibrational motion. In an alternative embodiment, the perforated baseplate 304 can be made of any suitable non-conductive material (e.g., plastic), and the structure 318 can be made of any suitable conductive material (e.g., aluminum), allowing the conductive surface 306 of the membrane film 302 to be placed directly against the perforated baseplate 304. In another embodiment, an ultrasonic transducer 400 (see FIG. 4) can be provided that includes a perforated baseplate 404 made of any suitable conductive material (e.g., aluminum), and a membrane film 402 having a conductive surface 406, which can be placed directly against the perforated baseplate 404 so long as a thin insulating coating (e.g., a polymer, oxide) is applied to either the conductive surface 406 of the membrane film 402 or a surface 410 of the perforated baseplate 404 facing and at least partially making contact with the conductive surface 406 of the membrane film 402. Such a thin insulating coating allows the generation of an electrical field, and thus an electrical force, but prevents a short circuit. In an alternative embodiment, the membrane film 402 and the perforated baseplate 404 can be separated from one another by an air gap.

With regard to the various configurations of the ultrasonic transducers 118 (see FIGS. 1*a* and 1*b*), 200*a* (see FIG. 2*a*), 200*b* (see FIG. 2*b*), 300 (see FIG. 3), and 400 (see FIG. 4) described herein, the electrical force created from a variable electric field produced by applying a voltage difference (e.g., an AC voltage) between the membrane film and the perforated baseplate of each ultrasonic transducer is primarily attractive, i.e., the electrical force operates to move the membrane film in a direction toward the perforated baseplate. Using a DC bias voltage under normal driving conditions, the "pull" of such a force created from the variable electric field can be either increased or decreased, but, typically, the pull of the force does not go negative. Moreover, the restoring force is mainly derived from the stiffness of the membrane film of the respective ultrasonic transducer.

Figure 5A:
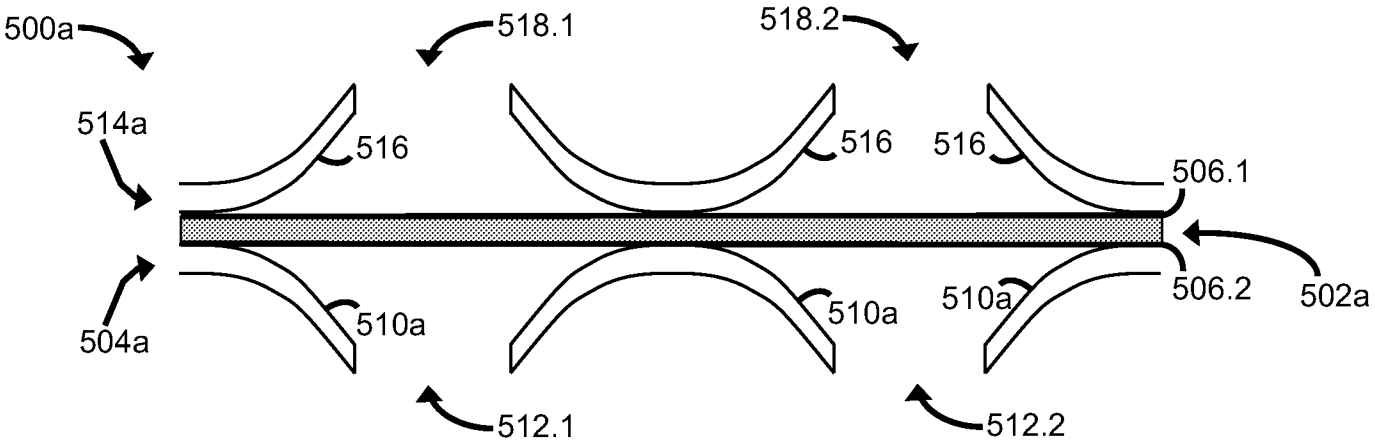
FIG. 5*a* is a cross-sectional view of still another exemplary embodiment of the ultrasonic transducer of FIGS. 1*a* and 1*b*, in which the ultrasonic transducer includes a membrane film having two opposing conductive surfaces, and two perforated baseplates, and each conductive surface of the membrane film is positioned adjacent or proximate to a respective one of the perforated baseplates, thereby providing a two-way driving configuration of the ultrasonic transducer.

Based on the various ultrasonic transducer configurations described herein, it is possible to provide a two-way driving configuration of an ultrasonic transducer. A cross-sectional view of such a two-way driving configuration is illustrated in FIG. 5*a*, which depicts an exemplary ultrasonic transducer 500*a* that includes a membrane film 502*a*, a first perforated baseplate 504*a*, and a second perforated baseplate 514*a*. As shown in FIG. 5*a*, the membrane film 502*a* has conductive surfaces 506.1, 506.2 on its opposing sides. The first perforated baseplate 504*a* includes a surface 510*a* with a plurality of apertures, openings, or perforations 512.1, 512.2 formed thereon or therethrough. Likewise, the second perforated baseplate 514*a* includes a surface 516 with a plurality of apertures, openings, or perforations 518.1, 518.2 formed thereon or therethrough. The conductive surface 506.1 of the membrane film 502*a* is disposed against the surface 516 of the second perforated baseplate 514*a*, and the conductive surface 506.2 of the membrane film 502*a* is disposed against the surface 510*a* of the first baseplate 504*a*. The first and second perforated baseplates 504*a*, 514*a* can each be made of a conductive material such as aluminum and coated with a thin insulating material (e.g., a polymer, oxide). By applying a voltage difference (e.g., an AC voltage) between the conductive surface 506.2 of the membrane film 502*a* and a conductive surface of the first perforated baseplate 504*a*, and applying another voltage difference (e.g., an AC voltage), typically with opposite phase and/or polarity, between the conductive surface 506.1 of the membrane film 502*a* and a conductive surface of the second perforated baseplate 514*a*, the membrane film 502*a* can be made to move alternately in a first direction toward the first perforated baseplate 504*a* and in a second direction toward the second perforated baseplate 514*a*. As a result, the output capability of the ultrasonic transducer 500*a* in the two-way driving configuration can be increased up to at least two times the output capability of conventional ultrasonic transducers in known one-way driving configurations.

While the membrane film 502*a* of the ultrasonic transducer 500*a* is disclosed herein as having two conductive surfaces 506.1, 506.2 on its opposing sides, the ultrasonic transducer 500*a* may alternatively be configured to include a membrane film with a conductive surface on just one of its sides. Such an alternative configuration would avoid the need for an insulating coating on one of the baseplates 504*a*, 514*a*. Electrically driving such ultrasonic transducers in the two-way driving configuration can be performed using any suitable combination of AC and DC voltages relative to the conductive surface(s) of the membrane film and the conductive surface(s) of the baseplate(s). Because an electrical force can be generated from voltage differences, each non-moveable conductive surface of a baseplate can have a varying voltage relative to a corresponding conductive surface on a moveable membrane film in order to produce vibrational motion. Such vibrational motion of the membrane film can be increased or magnified by applying a DC bias voltage relative to the respective conductive surfaces of the membrane film and the baseplate. Moreover, the membrane film or an insulating coating on the baseplate(s) can have electret properties, and can be used to replace or augment the applied DC bias voltage.

Figure 5B:
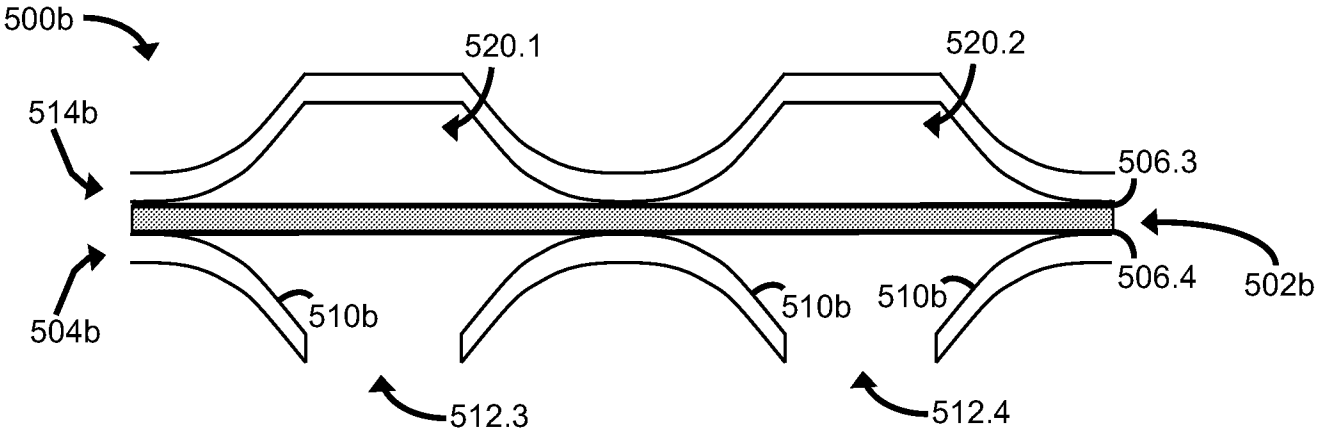
FIG. 5*b* is a cross-sectional view of an alternative embodiment of the ultrasonic transducer of FIG. 5*a*, in which one side of the two-way driving configuration is made to terminate at one or more chambers in order to provide a one-way output configuration with increased output drive capability.

It is noted that one side of the ultrasonic transducer 500*a* in the two-way driving configuration can be made to terminate at one or more chambers (e.g., one or more chambers 520.1, 520.2; see FIG. 5*b*) in order to provide an ultrasonic transducer 500*b* (see FIG. 5*b*) in a one-way output configuration with increased output drive capability. A cross-sectional view of the ultrasonic transducer 500*b* in the one-way output configuration is illustrated in FIG. 5*b*, which depicts a membrane film 502*b*, a perforated baseplate 504*b*, and a structure 514*b* that forms the plurality of chambers 520.1-520.2 for absorbing, redirecting, and/or reflecting output energy from a non-radiating side of the ultrasonic transducer 500*b* to a radiating side of the ultrasonic transducer 500*b*, or by acting as an acoustic compliance to provide a restoring force. As shown in FIG. 5*b*, the membrane film 502*b* has conductive surfaces 506.3, 506.4 on its opposing sides. The perforated baseplate 504*b* includes a surface 510*b* with a plurality of apertures, openings, or perforations 512.3, 512.4 formed thereon or therethrough. The conductive surface 506.3 of the membrane film 502*b* is disposed against the surface of the structure 514*b*, and the conductive surface 506.4 of the membrane film 502*b* is disposed against the surface 510*b* of the baseplate 504*b*. For example, the structure 514*b* forming the plurality of chambers 520.1-520.2 may be made from any suitable conductive material, or any suitable non-conductive material, which, for example, may be molded from plastic or any other suitable malleable material. Further, the plurality of chambers 520.1-520.2 may be configured to be in registration or aligned with the plurality of apertures, openings, or perforations 512.3-512.4, respectively. During operation of the ultrasonic transducer 500*b*, output energy resulting from the membrane film 502*b* being made to move in a direction toward the structure 514*b* can be redirected and/or reflected, by action of the plurality of chambers 520.1-520.2, toward the respective apertures, openings, or perforations 512.3, 512.4 in the perforated baseplate 504*b*, thereby increasing the output drive capability of the ultrasonic transducer 500*b* beyond what was heretofore achievable in conventional ultrasonic transducers in known one-way driving configurations.

It is noted that a DC bias voltage can be employed to magnify the electrical force of attraction causing the membrane film 502*a* to move in the first direction toward the first perforated baseplate 504*a*, as well as the electrical force of attraction causing the membrane film 502*a* to move in the second direction toward the second perforated baseplate 514*a*. Further, the apertures, openings, or perforations 512.1, 512.2, 518.1, 518.2 (see FIG. 5*a*) can each be circular, elongated, slotted, oval, or any other suitable shape for maximizing the performance of the ultrasonic transducer 500*a*. In one embodiment, some or all of the apertures, openings, or perforations 512.1, 512.2, 518.1, 518.2 can be flared like acoustic horns. In addition, the thin insulating material coating the respective first and second perforated baseplates 504*a*, 514*a* can be implemented as either a thin polymer such as Mylar, urethane, acrylic, or any other suitable polymer, or an oxide such as iron oxide, aluminum oxide, or any other suitable oxide. It is further noted that the ultrasonic transducer designs described herein can be used in parametric array loudspeaker systems or any other suitable systems and/or applications that employ sonic and/or ultrasonic transducers, for transmission and/or reception. Such ultrasonic transducer designs can be segmented for use with a phased array, or multiple discrete elements can be used in one ultrasonic transducer assembly for ruggedness and assembly convenience.

Figure 6:
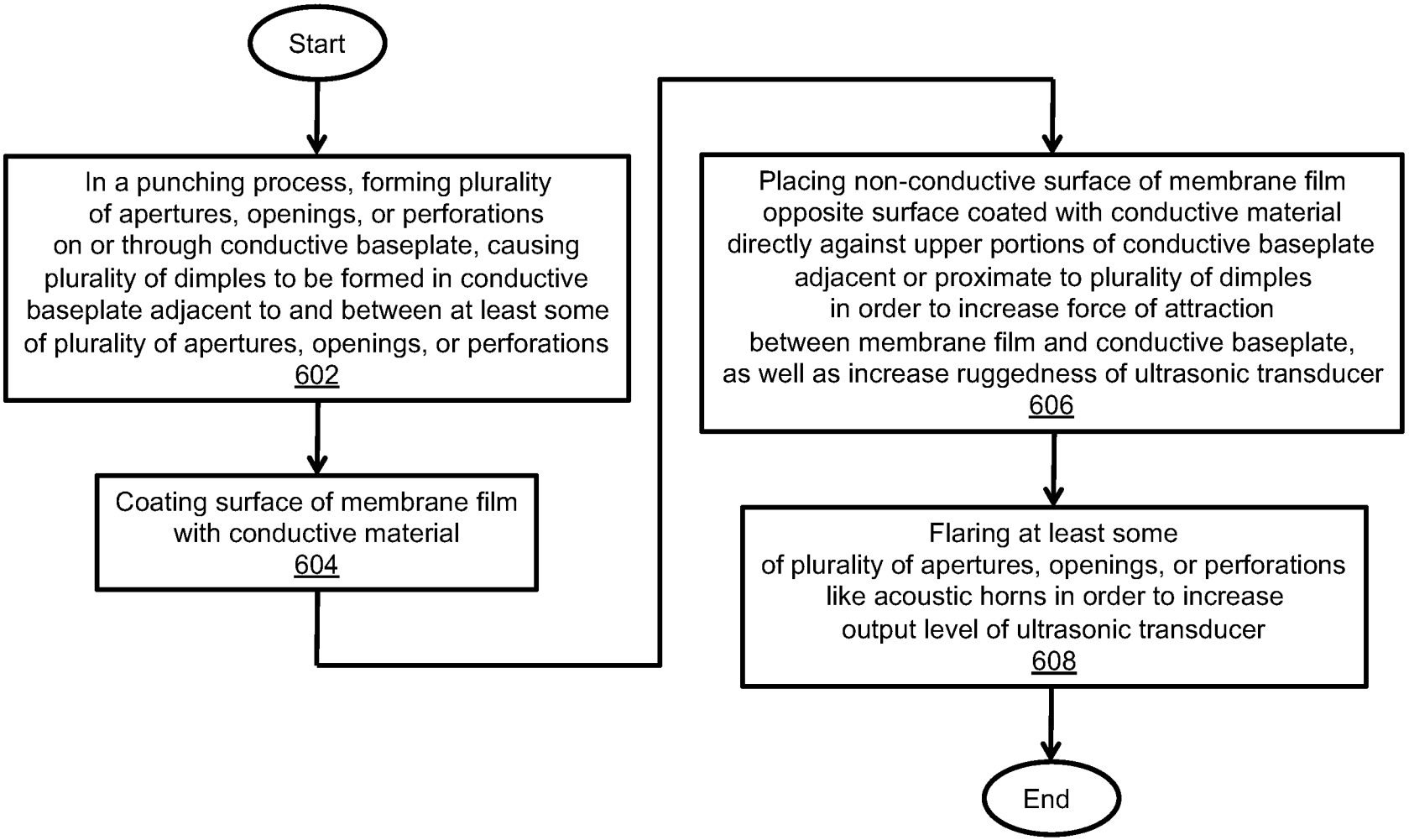
FIG. 6 is a flow diagram of an exemplary method of manufacturing the ultrasonic transducer of FIGS. 2*a* and 2*b*.

An exemplary method of manufacturing an ultrasonic transducer that includes a conductive baseplate and a membrane film is described herein with reference to FIG. 6. As depicted in block 602, in a punching process, a plurality of apertures, openings, or perforations are formed on or through the conductive baseplate, causing a plurality of dimples to be formed in the conductive baseplate adjacent to and between at least some of the plurality of apertures, openings, or perforations. As depicted in block 604, a surface of the membrane film is coated with a conductive material. As depicted in block 606, a non-conductive surface of the membrane film opposite the surface coated with the conductive material is placed directly against upper portions of the conductive baseplate adjacent or proximate to the plurality of dimples in order to increase the electrical force of attraction between the membrane film and the conductive baseplate, as well as increase the ruggedness of the ultrasonic transducer. As depicted in block 608, at least some of the plurality of apertures, openings, or perforations are flared like acoustic horns in order to increase an output level of the ultrasonic transducer.

It will be appreciated by those of ordinary skill in the art that modifications to and variations of the above-described ultrasonic transducers may be made without departing from the inventive concepts disclosed herein. Accordingly, the invention should not be viewed as limited except as by the scope and spirit of the appended claims.

What is claimed is:

1. An ultrasonic transducer for transmission or reception of acoustic signals, comprising:

a baseplate having a conductive surface; and a vibrator layer, wherein the baseplate has a plurality of perforations formed therethrough, and a plurality of dimples formed thereon adjacent to and between at least some of the plurality of perforations, wherein the plurality of dimples have sloping portions that are tangent to upper portions of the conductive surface near the vibrator layer, wherein the sloping portions extend from the upper portions and terminate at one or more of the plurality of perforations, and wherein the vibrator layer is disposed adjacent to the upper portions of the conductive surface.

2. The ultrasonic transducer of claim 1 wherein the vibrator layer has a conductive surface and a non-conductive surface opposite the conductive surface, and wherein the non-conductive surface of the vibrator layer is disposed directly against the upper portions of the conductive surface of the baseplate.

3. The ultrasonic transducer of claim 1 wherein the plurality of perforations formed through the baseplate have corresponding dimensions, and wherein the dimensions of at least some of the plurality of perforations are configured to determine a frequency response of the ultrasonic transducer.

4. The ultrasonic transducer of claim 3 wherein the dimensions of at least some of the plurality of perforations are configured to vary across the baseplate to cause different regions of the baseplate to produce different frequency responses of the ultrasonic transducer.

5. The ultrasonic transducer of claim 1 wherein at least some of the plurality of perforations formed through the baseplate are flared like acoustic horns.

6. The ultrasonic transducer of claim 1 wherein the sloping portions include shallow sloping portions and wall portions, wherein the shallow sloping portions extend from the upper portions of the conductive surface to the wall portions, wherein the wall portions extend from the shallow sloping portions and terminate at one or more of the plurality of perforations, and wherein the wall portions have an increased slope relative to the shallow sloping portions.

7. An ultrasonic transducer for transmission or reception of acoustic signals, comprising:

a baseplate having a conductive surface; and a vibrator layer, wherein the baseplate has a plurality of perforations formed therethrough, and a plurality of dimples formed thereon adjacent to and between at least some of the plurality of perforations, wherein the plurality of dimples have sloping portions that extend from upper portions of the conductive surface and terminate at one or more of the plurality of perforations, wherein the vibrator layer is disposed adjacent to the upper portions of the conductive surface, wherein the vibrator layer has a conductive surface and a non-conductive surface opposite the conductive surface, wherein at least the upper portions of the conductive surface are coated with an insulating material, and wherein the conductive surface of the vibrator layer is disposed directly against the upper portions of the conductive surface coated with the insulating material.

8. An ultrasonic transducer for transmission or reception of acoustic signals, comprising:

a baseplate having a conductive surface;

a vibrator layer, wherein the baseplate has a plurality of perforations formed therethrough, and a plurality of dimples formed thereon adjacent to and between at least some of the plurality of perforations, wherein the plurality of dimples have sloping portions that extend from upper portions of the conductive surface and terminate at one or more of the plurality of perforations, and wherein the vibrator layer is disposed adjacent to the upper portions of the conductive surface; and one or more chamber structures disposed adjacent to the vibrator layer opposite the baseplate, the one or more chamber structures being operative to redirect or reflect output energy from a non-radiating side of the baseplate to a radiating side of the baseplate.

9. The ultrasonic transducer of claim 8 wherein at least some of the chamber structures are aligned with at least some of the perforations, respectively, formed through the baseplate.

10. An ultrasonic transducer for transmission or reception of acoustic signals, comprising:

a first baseplate having a first conductive surface;

a vibrator layer, wherein the first baseplate has a plurality of first perforations formed therethrough, and a plurality of first dimples formed thereon adjacent to and between at least some of the plurality of first perforations, wherein the plurality of first dimples have sloping portions that extend from upper portions of the first conductive surface and terminate at one or more of the plurality of first perforations, and wherein the vibrator layer is disposed adjacent to the upper portions of the first conductive surface; and a second baseplate having a second conductive surface, wherein the second baseplate has a plurality of second perforations formed therethrough, and a plurality of second dimples formed adjacent to and between at least some of the plurality of second perforations, the second conductive surface having upper portions adjacent or proximate to the plurality of second dimples, respectively, and wherein the vibrator layer is disposed between the first baseplate and the second baseplate, the vibrator layer being adjacent or proximate to the upper portions of the first conductive surface of the first baseplate and adjacent or proximate to the upper portions of the second conductive surface of the second baseplate.

11. The ultrasonic transducer of claim 10 wherein the vibrator layer has conductive surfaces on opposing sides thereof, and wherein the upper portions of the first conductive surface of the first baseplate and the upper portions of the second surface of the second baseplate are coated with an insulating material.

12. The ultrasonic transducer of claim 11 wherein the conductive surfaces on the opposing sides of the vibrator layer are disposed directly against (1) the upper portions of the first conductive surface coated with the insulating material, and (2) the upper portions of the second conductive surface coated with the insulating material, respectively.

13. The ultrasonic transducer of claim 10 wherein at least some of the plurality of first perforations formed through the first baseplate, and at least some of the plurality of second perforations formed through the second baseplate, are flared like acoustic horns.

14. A method of manufacturing an ultrasonic transducer for transmission or reception of acoustic signals, the ultrasonic transducer having a baseplate and a vibrator layer, the baseplate having a conductive surface, the method comprising:

forming a plurality of perforations through the baseplate;

forming a plurality of dimples on the baseplate adjacent to and between at least some of the plurality of perforations, the plurality of dimples have sloping portions that are tangent to upper portions of the conductive surface near the vibrator layer, the sloping portions extending from the upper portions and terminating at one or more of the plurality of perforations; and placing the vibrator layer adjacent or proximate to the upper portions of the conductive surface of the baseplate.

15. The method of claim 14 further comprising:

using the baseplate with a phased transducer array.

* * * * *